United States Patent [19]

Deuring et al.

[11] Patent Number: 4,815,425

[45] Date of Patent: Mar. 28, 1989

[54] DIAPHRAGM SEAL FOR A VALVE TAPPET

[75] Inventors: Hans Deuring, Burscheid; Klaus Pesch, Leverkusen, both of Fed. Rep. of Germany

[73] Assignee: Goetze AG, Burscheid, Fed. Rep. of Germany

[21] Appl. No.: 185,384

[22] Filed: Apr. 25, 1988

[30] Foreign Application Priority Data

Apr. 24, 1987 [DE] Fed. Rep. of Germany ..... 3713680

[51] Int. Cl.[4] ..... F01L 1/24; F01L 1/14

[52] U.S. Cl. ..... 123/90.58

[58] Field of Search ..... 123/90.43, 90.46, 90.55, 123/90.56, 90.57, 90.58, 90.59

[56] References Cited

U.S. PATENT DOCUMENTS

| | | | |
|---|---|---|---|
| 4,397,271 | 8/1983 | Gardner | 123/90.58 X |
| 4,610,225 | 9/1986 | Camosso et al. | 123/90.58 X |
| 4,632,075 | 12/1986 | Camosso et al. | 123/90.58 |
| 4,656,978 | 4/1987 | Deuring | 123/90.58 X |
| 4,694,790 | 9/1987 | Kowal | 123/90.58 |
| 4,715,334 | 12/1987 | Buente et al. | 123/90.58 |
| 4,735,197 | 4/1988 | Ishida et al. | 123/90.58 |

*Primary Examiner*—Willis R. Wolfe

*Attorney, Agent, or Firm*—Spencer & Frank

[57] ABSTRACT

A valve tappet assembly has a hollow tappet body, a valve clearance adjusting element spaced from the inner wall face of the tappet body and having a circumferential groove, an elastomer annular diaphragm having an outer edge zone adjoining the inner wall face of the tappet body and an inner edge zone adjoining the outer face of the valve clearance adjusting element, a first radially inwardly projecting circumferential rib provided at the inner edge zone and received in the circumferential groove; an outer and an inner clamping ring circumferentially pressing the outer edge zone against the inner wall face at the tappet and, respectively, the inner edge zone against the outer wall face of the valve clearance adjusting element to provide respective circumferential sealing zones; and a second radially inwardly projecting circumferential rib in the inner edge zone, situated adjacent the first rib and being pressed into circumferential engagement with the outer wall face of the valve clearance adjusting element adjacent the circumferential groove thereof.

9 Claims, 1 Drawing Sheet

DIAPHRAGM SEAL FOR A VALVE TAPPET

BACKGROUND OF THE INVENTION

This invention relates to a tappet (valve lifter) installed between a valve stem and a valve actuating element in internal combustion engines. The hollow tappet houses, coaxially therewith, a closed hydraulic valve clearance adjusting system having a piston-like valve clearance adjusting element and including an elastomer diaphragm that extends from the inner circumference of the hollow tappet body to the outer circumference of the valve clearance adjusting element. The diaphragm is clamped at its beaded circular ends by clamping rings against the component to be sealed. In the zone of the seating face a circumferential groove is provided in the component to be sealed, for receiving an annular projection of the diaphragm.

A valve tappet of the above-outlined type is known and is disclosed, for example, in U.S. Pat. No. 4,397,271. In this prior art construction, the diaphragm situated in the annular space between the tappet and the valve clearance adjusting element is secured by means of clamping rings vulcanized into the bead-like end zones of the diaphragm. While the end zone of the diaphragm engaging the inner circumferential surface of the tappet is axially displaceable, the end zone of the diaphragm which engages the outer circumferential face of the valve clearance adjusting element is axially immobilized in a groove provided in the valve clearance adjusting element. It is a disadvantage of this type of securement of the diaphragm at the valve clearance adjusting element that the service life of the diaphragm is limited. On the one hand, the clamping ring vulcanized into the diaphragm bead is of such small dimensions that it is not capable of exerting high clamping forces and, on the other hand, the cooperating seating face of the valve clearance adjusting element is axially very narrow so that after a certain service period a failure of the seal in those locations must necessarily occur.

During operation, the valve tappet is exposed to high temperature differences and extremely high acceleration forces. The elastomer component which contracts or expands in response to temperature changes is not capable of sealing the associated seating face and thus, due to the high acceleration forces, a slippage of the diaphragm with respect to the seating face occurs. In order to prevent a relative displacement between the diaphragm and the valve clearance adjusting element, German Offenlegungsschrift (non-examined published application) No. 3,542,708 proposes to bond the valve clearance adjusting element with the diaphragm by vulcanization and to provide an annular projection in a corresponding groove of a bottom wall. In this construction, the diaphragm is coupled entirely rigidly with the valve clearance adjusting element so that in case of a temperature change or under the effect of fluid the changing volume cannot plastically deform. This causes stress peaks in the diaphragm which may cause rupture thereof.

It is a further disadvantage of prior art arrangements that after an extended service period the diaphragm vulcanized to the valve clearance adjusting element may become separated therefrom and a gap appears. The hydraulic medium then escapes through the gap to the base plate and subsequently flows past the projection of the diaphragm into the space between the base plate and the diaphragm. The axial pressure of the coil spring which is situated within the tappet and which engages the diaphragm is not capable of pressing the diaphragm about its entire circumference uniformly against the base plate since a coil spring is not adapted to exert a pressing force along the entire circumference.

SUMMARY OF THE INVENTION

It is an object of the invention to provide an improved tappet of the above-outlined type for extending the service life of the diaphragm seal therein by ensuring a more secure and more tightly sealed seat of the diaphragm in the tappet to result in a long service life even in case of extreme temperature differences during operation.

This object and others to become apparent as the specification progresses, are accomplished by the invention, according to which, briefly stated, in addition to the first circumferential projection of the membrane there is provided at least one additional circumferential projection which, in the installed state of the tappet, is urged into engagement with a corresponding seating face of the component to be sealed, adjacent the circumferential groove thereof.

By virtue of the invention as outlined above, a sealing zone with high surface pressure is obtained which ensures a secure and tightly sealed seat during a long service period.

According to a further feature of the invention, on either side of the second projection of the diaphragm free spaces are provided into which the elastomer material of the stressed second projection may deflect. In particular, one of the free spaces is bounded by a conical taper of the diaphragm terminal on the diaphragm side and is formed by a clearance between the first projection and the associated groove. The material expanding during heating plastically deforms into the free spaces, as a result of which the clearance between the first projection and the associated groove is completely filled, thus obtaining a snap-in seat. By virtue of the taper of the elastomer part there is obtained a gradual (soft) relaxation of tension in order to prevent ruptures in case of stress peaks.

According to an additional feature of the invention, the projections have the shape of a circular segment. The clamping ring provided in the zone of the valve clearance adjusting element has an angled cross section so that the diaphragm may be supported on the radially oriented leg thereof. Further, the clamping ring may have a cup-shaped cross section as a result of which the base of the cup axially supports the diaphragm and the valve clearance adjusting element.

In accordance with still another feature of the invention, the clamping ring is, for clamping the diaphragm in the vulcanizing tool, formed on the bead-like ends of the diaphragm. By virtue of the particular configuration of the clamping ring the latter may be positively received in the vulcanizing mold at the outer diameter whereby a highly satisfactory centering in the mold is achieved.

The elastomer which shrinks at low temperatures is, according to the invention, pressed with a sufficiently large radial force against the valve clearance adjusting element.

DESCRIPTION OF THE PREFERRED EMBODIMENT

Figure 1:
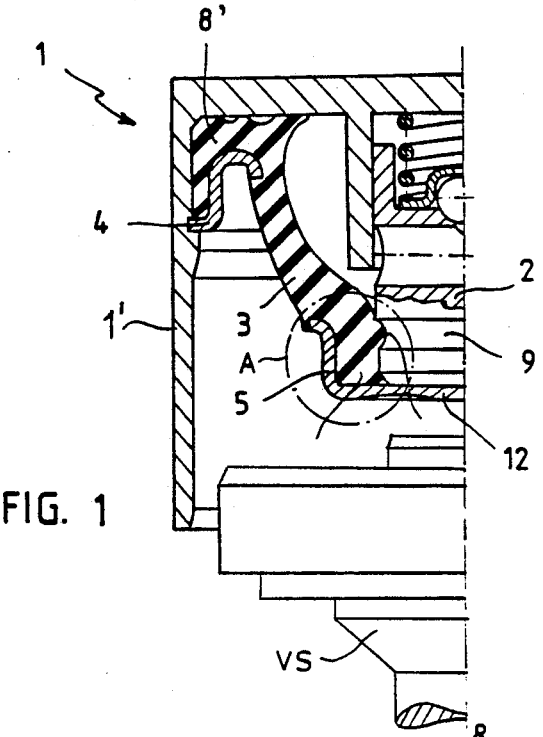
FIG. 1 is an axial sectional view of one symmetric half of a preferred embodiment of the invention shown in the operational state.

Turning to FIG. 1, there is illustrated a valve tappet 1 in an assembled state, designed to be installed between a valve stem VS and a non-illustrated valve actuator, such as a rotary cam of the engine cam shaft. The hollow tappet body 1' houses a valve clearance adjusting (compensating) element 2 which forms part of a closed hydraulic system hermetically sealed from the environment by a generally cup-shaped elastic diaphragm 3 having bead-like thickened annular end zones 8, 8'. The radially outer end zone 8' is secured to the inner circumferential face of the tappet body 1' by a radially outer clamping ring 4, while the radially inner end zone 8 is secured to the outer circumferential face of the valve clearance adjusting element 2 by a radially inner clamping ring 5.

Figure 2:
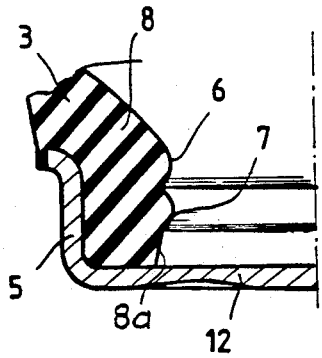
FIG. 2 is an enlarged sectional view of inset A of FIG. 1 shown in the dismounted state.

The bead-like end zone 8 of the diaphragm 3 arranged at the outer circumference of the valve clearance adjusting element 2 has two annular projections (ribs) 6 and 7 as shown in FIG. 2. Axially underneath the projection 7 the bead-like end zone 8 tapers by virtue of an outwardly flaring conical wall 8*a* and is supported by the clamping ring 5 which has a cup-shaped configuration. The end zone 8 is formed on the clamping ring 5 in a vulcanizing tool. Such a vulcanization merely serves for facilitating installation, it has no effect on the sealing function so that a possible separation of the clamping ring after a longer service period does not cause a failure of the seal.

Figure 3:
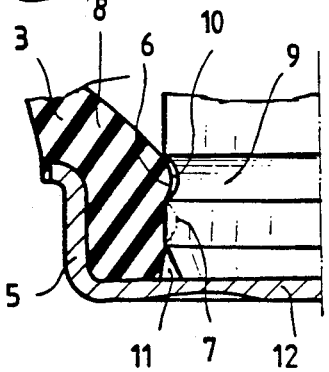
FIG. 3 is an enlarged sectional view of inset A of FIG. 1, illustrated in the installed, but idling (non-operating state).

In the installed state, as shown in FIG. 3, the projection 6 extends into a circumferential groove 9 of the valve clearance adjusting element 2, while preserving, however, a clearance 10 between the groove 9 and the projection 6. A further free space 11 is defined by the conical tapering portion of the end zone 8, the outer circumferential face of the valve clearance adjusting element 2 and a bottom 12 of the cup-shaped clamping ring 5. The bottom 12 extends radially across the outwardly oriented radial end face of the valve clearance adjusting element 2 and is thus interposed between the valve clearance adjusting element and the valve stem VS of an intake or exhaust valve. While the projection 6 extends into the groove 9 in a stressless state, the projection 7 lies against the cylindrical outer face of the valve clearance adjusting element 2 under stress.

Upon heating or swelling caused by a hydraulic fluid contained in the space sealed by the diaphragm 3, the diaphragm material flows (plastically deforms) into the free spaces 10 and 11 (FIG. 1) whereby the projection 6, together with the groove 9 form a tight and secure connection and further, the seal obtains an additional sealing location by virtue of the diaphragm material expanding into the space 11 without, however, any stresses appearing within the diaphragm 3.

The present disclosure relates to subject matter contained in Federal Republic of Germany Patent Application No. P 37 13 680.1 (filed Apr. 24th, 1987).

It will be understood that the above description of the present invention is susceptible to various modifications, changes and adaptations, and the same are intended to be comprehended within the meaning and range of equivalents of the appended claims.

What is claimed is:

1. In a valve tappet assembly adapted to be installed between a valve stem and a valve actuator in an internal combustion engine, said assembly including a hollow tappet body having a generally cylindrical inner wall face;

a hydraulic valve clearance adjusting unit accommodated in said tappet body and having a valve clearance adjusting element provided with a generally cylindrical outer wall face spaced from the inner wall face of said tappet body and a circumferential groove provided in said outer wall face;

an elastomer annular diaphragm having a radially outer edge zone circumferentially adjoining the inner wall face of said tappet body and a radially inner edge zone circumferentially adjoining the outer wall face of said element; said diaphragm having, at said radially inner edge zone, a first radially inwardly projecting circumferential rib received in said circumferential groove;

a radially outer and a radially inner clamping ring circumferentially pressing said radially outer edge zone against said inner wall face and, respectively, said radially inner edge zone against said outer wall face to provide respective circumferential sealing zones between the diaphragm and the tappet body and between the diaphragm and the valve clearance adjusting element;

the improvement wherein said diaphragm has a second radially inwardly projecting circumferential rib in said radially inner edge zone, situated adjacent said first rib and being pressed into circumferential engagement with said outer wall face of said valve clearance adjusting element adjacent said circumferential groove thereof.

2. A valve tappet assembly as defined in claim 1, wherein the radially inner clamping ring has an angled cross section.

3. A valve tappet assembly as defined in claim 1, wherein said radially outer and inner clamping rings are secured to the respective radially outer and inner end zones of said diaphragm by a vulcanized bond.

4. A valve tappet assembly as defined in claim 1, further comprising means defining free annular spaces flanking said second circumferential rib and arranged for receiving, during operation, diaphragm parts undergoing deformation.

5. A valve tappet assembly as defined in claim 4, wherein each free annular space has a cross section shaped as a circular segment.

6. A valve tappet assembly as defined in claim 4, wherein said radially inner edge zone of said diaphragm has a conical wall portion flaring in a direction away from said second circumferential rib; said conical wall portion forming part of the means defining one of said free annular spaces.

7. A valve tappet assembly as defined in claim 4, wherein the means defining one of said free annular spaces comprises an annular surface portion of said first circumferential rib and an annular surface portion of said circumferential groove.

8. A valve tappet assembly as defined in claim 1, wherein said valve clearance adjusting element has an end face; and further wherein said radially inner clamping ring is generally cup-shaped and has a bottom extending across said end face and being adapted to be situated between a free end of the valve stem and said valve clearance adjusting element.

9. A valve tappet assembly as defined in claim 8, further wherein said bottom wall of said radially inner clamping ring is in an axial supporting engagement with said radially inner end zone of said diaphragm.

* * * * *